US010536764B2

(12) United States Patent
Beaudoin et al.

(10) Patent No.: US 10,536,764 B2
(45) Date of Patent: Jan. 14, 2020

(54) INTEGRATING WAX GUARDS INTO EARPHONE EAR TIPS

(71) Applicant: Bose Corporation, Framingham, MA (US)

(72) Inventors: Brian David Beaudoin, Medway, MA (US); Benjamin N. Davies, Northborough, MA (US); Daniel K. Lee, Framingham, MA (US); Michael Andrew Zalisk, Arlington, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/864,631

(22) Filed: Jan. 8, 2018

(65) Prior Publication Data

US 2019/0215595 A1 Jul. 11, 2019

(51) Int. Cl.
*H04R 1/10* (2006.01)

(52) U.S. Cl.
CPC ..... *H04R 1/1016* (2013.01); *H04R 1/1058* (2013.01)

(58) Field of Classification Search
CPC .... H04R 1/1016; H04R 1/1058; H04R 1/023; H04R 25/654; H04R 2460/17; H04R 1/1075; H04R 2201/003; H04R 2225/025
See application file for complete search history.

(56) References Cited

U.S. PATENT DOCUMENTS 6,129,174 A * 10/2000 Brown ..... H04R 25/656 181/135
7,013,016 B2 * 3/2006 Wolf ..... H04R 25/654 381/324
7,471,800 B2 * 12/2008 Neilson ..... H04R 25/654 181/135
2008/0002835 A1 * 1/2008 Sapiejewski ..... H04B 1/202 381/71.6
2008/0019549 A1 * 1/2008 Ochsenbein ..... H04R 25/654 381/325
2009/0154747 A1 * 6/2009 Vestergaard ..... H04R 25/654 381/325
2010/0322452 A1 * 12/2010 Ladabaum ..... H04R 25/656 381/375

(Continued)

FOREIGN PATENT DOCUMENTS

WO 2010151492 A1 12/2010
WO 2013050094 A1 4/2013

OTHER PUBLICATIONS

International Search Report and Written Opinion dated Mar. 22, 2019 for PCT/US19/12638.

*Primary Examiner* — Oyesola C Ojo

(57) ABSTRACT

An ear tip for an earphone includes an interior mating surface for attaching the ear tip to the earphone, the interior mating surface at least partially surrounding a cavity where the earphone will be located when the ear tip may be so attached, an outer surface including features corresponding to human ear anatomy, a nozzle extension providing a passageway from the interior cavity to space outside the ear tip, a wax guard in the nozzle extension, the wax guard blocking the passageway, and a plurality of holes through the wax guard, the holes sized and arranged to allow sound to pass along the passageway, while inhibiting ear wax from passing along the passageway.

19 Claims, 6 Drawing Sheets

(56) References Cited

U.S. PATENT DOCUMENTS

| | | | | |
|---|---|---|---|---|
| 2011/0110544 | A1* | 5/2011 | Vestergaard | H04R 25/658 381/312 |
| 2012/0082336 | A1* | 4/2012 | Wubker | H04R 1/1016 381/380 |
| 2012/0250923 | A1* | 10/2012 | Beck | H04R 25/654 381/328 |
| 2015/0382099 | A1* | 12/2015 | Chu | H04R 1/2811 381/370 |
| 2016/0007110 | A1* | 1/2016 | Silvestri | H04R 1/2849 381/380 |
| 2016/0044398 | A1* | 2/2016 | Siahaan | B29C 43/021 381/380 |
| 2016/0269840 | A1* | 9/2016 | Dorn | H04R 25/654 |
| 2018/0109862 | A1* | 4/2018 | Lawand | H04R 1/1016 |
| 2019/0111456 | A1* | 4/2019 | Aase | A61F 11/006 |

* cited by examiner

INTEGRATING WAX GUARDS INTO EARPHONE EAR TIPS

BACKGROUND

This disclosure relates to wax guards for earphones, and in particular, integrating wax guards into ear tips.

FIG. 1 shows an earphone 100 having an earphone body 112 and an ear tip 102, as described in U.S. patent application Ser. No. 15/597,567, filed on May 17, 2017, titled Headphones with External Pressure Equalization Path, and incorporated here by reference. The ear tip incorporates a retaining feature from U.S. Pat. No. 8,989,426, titled Earpiece Positioning and Retaining, and an ear canal sealing feature from U.S. Pat. No. 8,737,669, titled Earpiece Passive Noise Attenuating, both also incorporated here by reference. U.S. Pat. No. 8,355,522, titled Earphone Cushions and also incorporated here by reference, describes a construction technique for such ear tips, shown in FIGS. 10A-10D, in which an inner core 502 of the ear tip 500 is formed of a harder material than the outer structures 504. The harder material provides structure and secure connection to the earphone body, while the softer material provides a compliant and comfortable surface for interfacing with the human body.

SUMMARY

In general, in one aspect, an ear tip for an earphone includes an interior mating surface for attaching the ear tip to the earphone, the interior mating surface at least partially surrounding a cavity where the earphone will be located when the ear tip may be so attached, an outer surface including features corresponding to human ear anatomy, a nozzle extension providing a passageway from the interior cavity to space outside the ear tip, a wax guard in the nozzle extension, the wax guard blocking the passageway, and a plurality of holes through the wax guard, the holes sized and arranged to allow sound to pass along the passageway, while inhibiting ear wax from passing along the passageway.

Implementations may include one or more of the following, in any combination. The wax guard may be generally elliptical in shape, with the plurality of holes arranged in a pattern uniformly spread around the wax guard. The wax guard may be generally elliptical in shape, with the plurality of holes arranged in a pattern confined to a circular shape having a diameter less than the shorter axis of the elliptical shape of the wax guard. The holes may be uniform in diameter along their extent through the wax guard. The plurality of holes may include seven holes having a diameter of around 0.031 mm. The holes may be tapered in diameter along their extent through the wax guard, having narrower ends on a surface of the wax guard facing out of the passageway and wider ends on a surface of the wax guard facing towards the cavity. The holes may have a diameter of around 0.031 mm at their narrow ends. The ear tip may be composed of two different materials having different hardness, a first, harder material providing the interior mating surface, and a second, softer material providing the outer surface; the wax guard may include the first material in a unitary structure with the material providing the interior mating surface. The first material may have a hardness between 70 and 85 Shore A. The second material may have a hardness of 20±4 Shore A. The mating surface and the wax guard may be positioned, relative to each other, such that when the earphone is attached to the ear tip, a gap will be present between an end of a nozzle of the earphone and the wax guard.

In general, in one aspect, an earphone includes an earphone body, including an aperture through which sound exits, and an exterior surface. An ear tip for attachment to the earphone includes an interior mating surface corresponding to at least a portion of the exterior surface of the earphone body, an outer surface including features corresponding to human ear anatomy, a nozzle extension providing a passageway from the aperture of the earphone body to space outside the earphone, a wax guard in the nozzle extension, the wax guard blocking the passageway, and a plurality of holes through the wax guard, the holes sized and arranged to allow sound to pass along the passageway, while inhibiting ear wax from passing along the passageway.

Implementations may include one or more of the following, in any combination. The earphone body may include a nozzle extending from the earphone body, the aperture located at an end of the nozzle and covered by a screen, with a gap remaining between the screen and the wax guard when the ear tip is attached to the earphone.

In general, in one aspect, an ear tip for an earphone includes a first material, having a first hardness, providing an interior mating surface for attaching the ear tip to the earphone, the interior mating surface at least partially surrounding a cavity where the earphone will be located when the ear tip may be so attached, and a second material, having a second hardness, providing an outer surface including features corresponding to human ear anatomy, a nozzle extension formed of at least the second material, providing a passageway from the interior cavity to space outside the ear tip. A wax guard is formed of the first material and located within the nozzle extension, the wax guard blocking the passageway. A plurality of holes through the wax guard are sized and arranged to allow sound to pass along the passageway, while inhibiting ear wax from passing along the passageway.

Advantages include preventing wax from entering the earphones, while allowing sound to pass unimpeded, without the use of additional parts. This allows extended wear of the earphones, such as overnight or all day.

All examples and features mentioned above can be combined in any technically possible way. Other features and advantages will be apparent from the description and the claims.

DESCRIPTION

Figure 1:
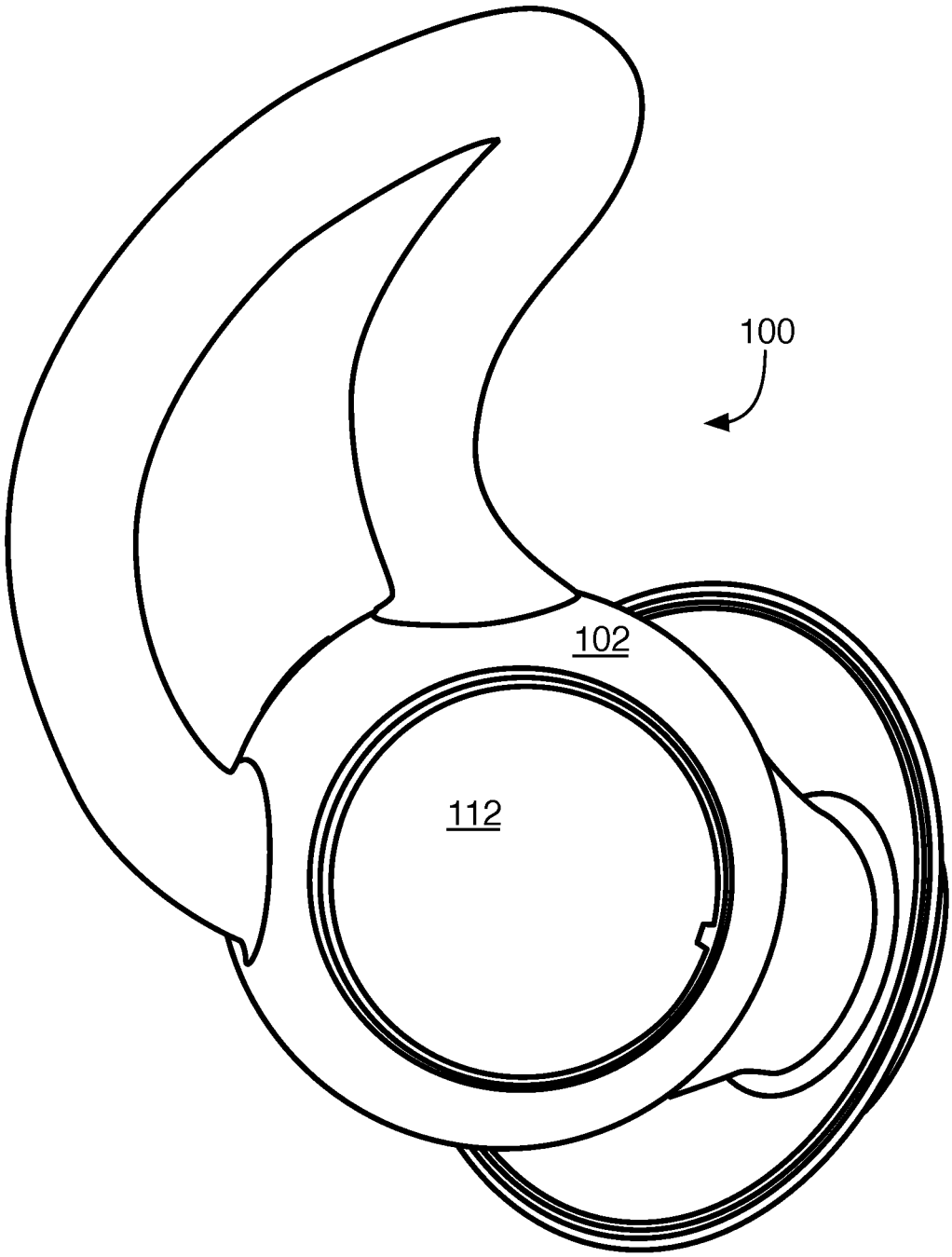
FIG. 1 shows a perspective view of an earphone.

A problem facing in-ear earphones that are intended to be worn for extended periods of time is the build-up of ear wax in the ear, and its migration into the earphone. In particular, the earphone shown in FIG. 1 is intended to be worn overnight, potentially for eight to even twelve hours at a time. Similarly, hearing aids are intended to be worn all day. If the ear wax migrates into the earphone, aside from impeding performance by physically blocking sound, it may interfere with earphone electronics.

Figure 2:
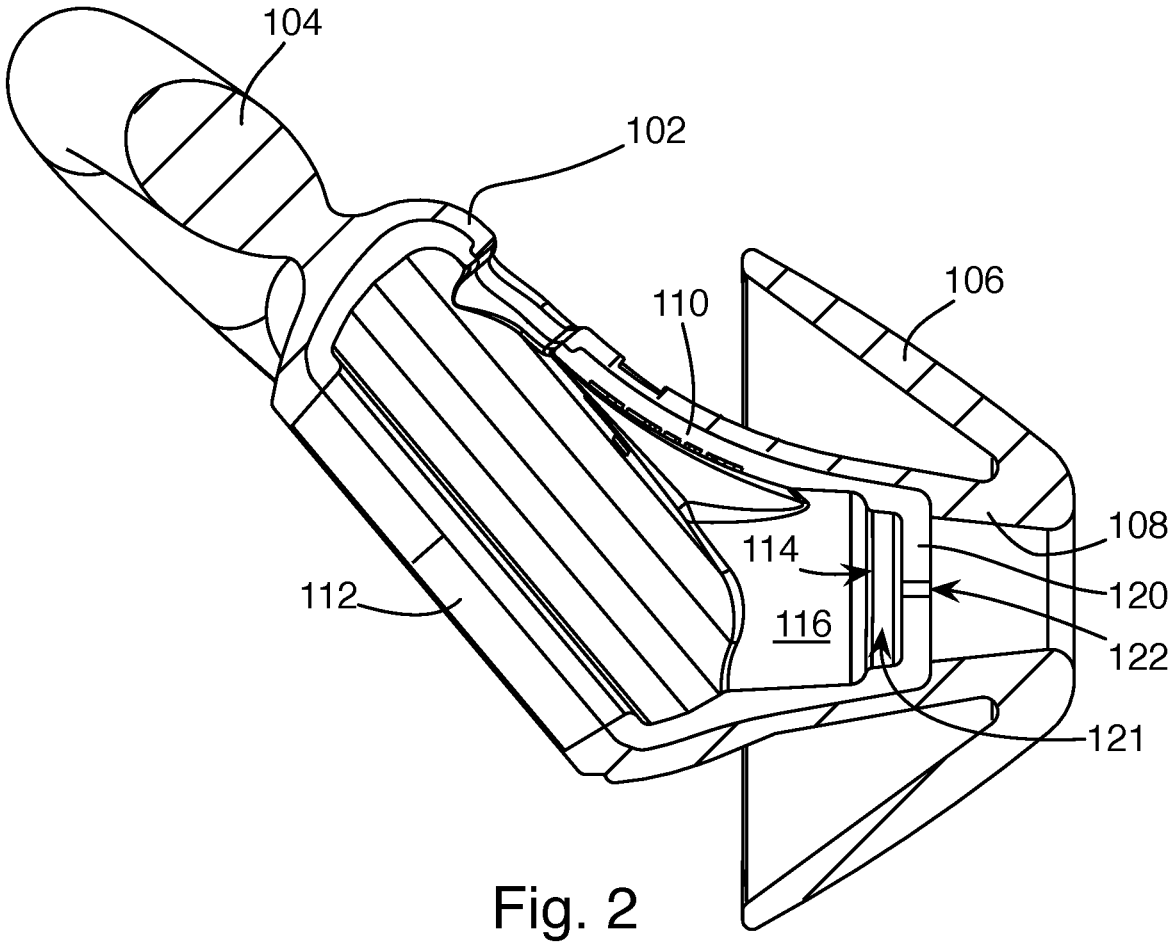
FIG. 2 shows a cross-sectional view of an improved version of the earphone of FIG. 1.
Figure 3:
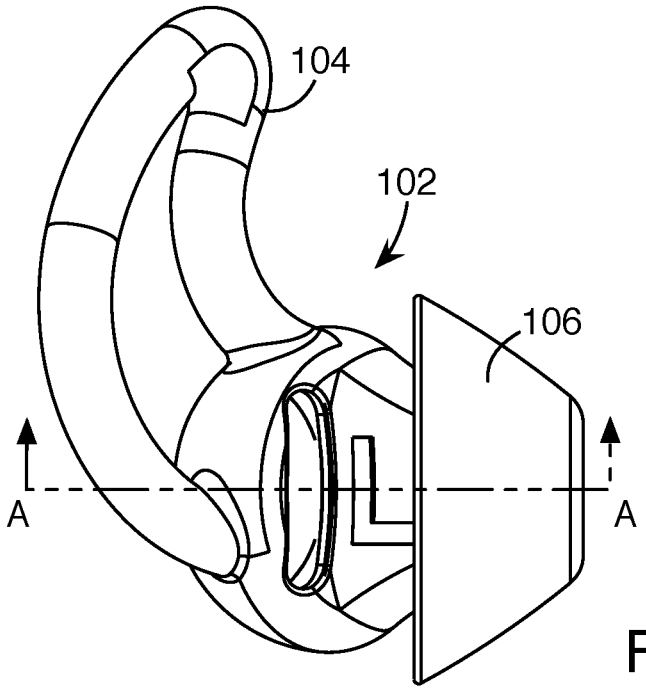
FIG. 3 shows a side view of the earphone of FIG. 2.

FIGS. 2 through 8 show modified ear tips that integrate a protective guard to prevent ear wax that enters through the outlet of the ear tip from reaching the earphone body and the electronics within it. In FIG. 2, the ear tip 102 includes a retaining member 104, an ear canal sealing structure 106 extending from a nozzle extension 108, and an inner core 110. The inner core provides a mating surface that corresponds to the outer shape of the earphone body 112, and includes a guard 120 that extends over the outlet 114 at the end of nozzle 116 of the earphone body 112. A hole 122 through the guard 120 allows sound to exit, while preventing ear wax from entering. More than one hole is likely provided, as discussed below; the sectional view used for FIG. 2 happens to show only one. Advantageously, a gap 121 between the guard 120 and a screen in the outlet 114 at the end of the nozzle 116 prevents wax from contacting the screen, which would be particularly difficult to clean. The ear tip can be removed from the earphone, and any wax caught by the guard can be removed, such as by washing the tip. Alternatively, the tip may be replaceable at significantly lower cost than the earphone body.

Figure 4:
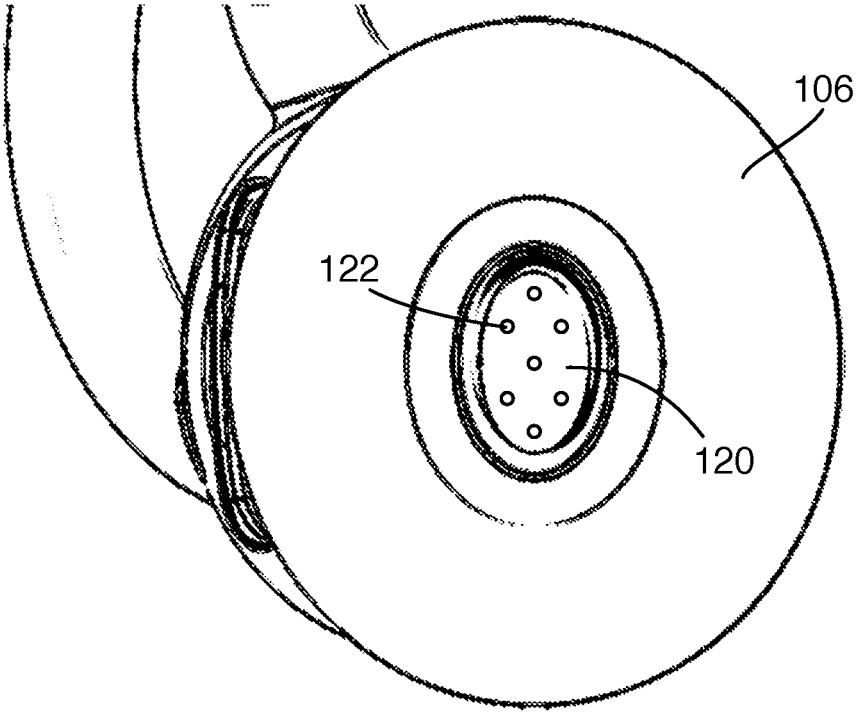
FIGS. 4, 6, and 8 show a front view of a headphone ear tip, looking into the outlet.
Figure 5:
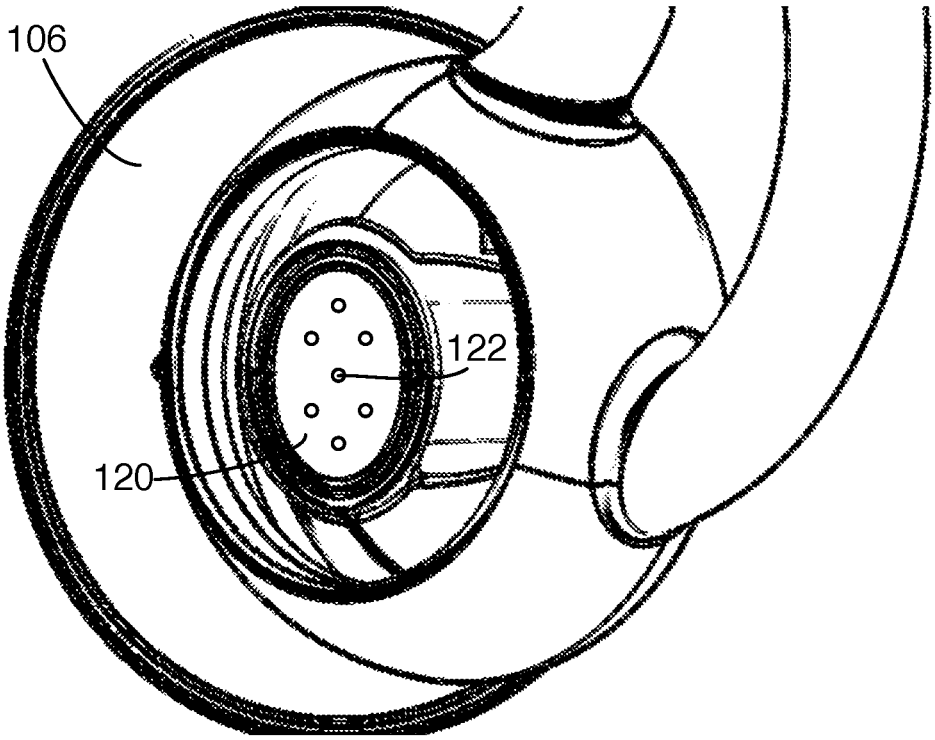
FIGS. 5, 7, and 9 show the reverse view of the ear tips of FIGS. 4, 6, and 8, looking through the ear tip in the direction of the outlet.
Figure 6:
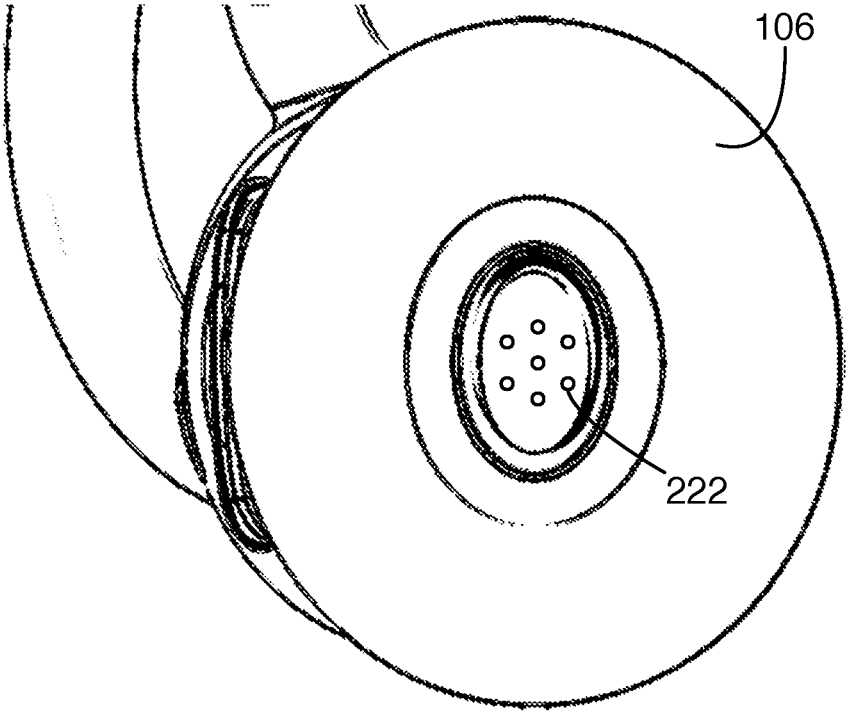
Figure 7:
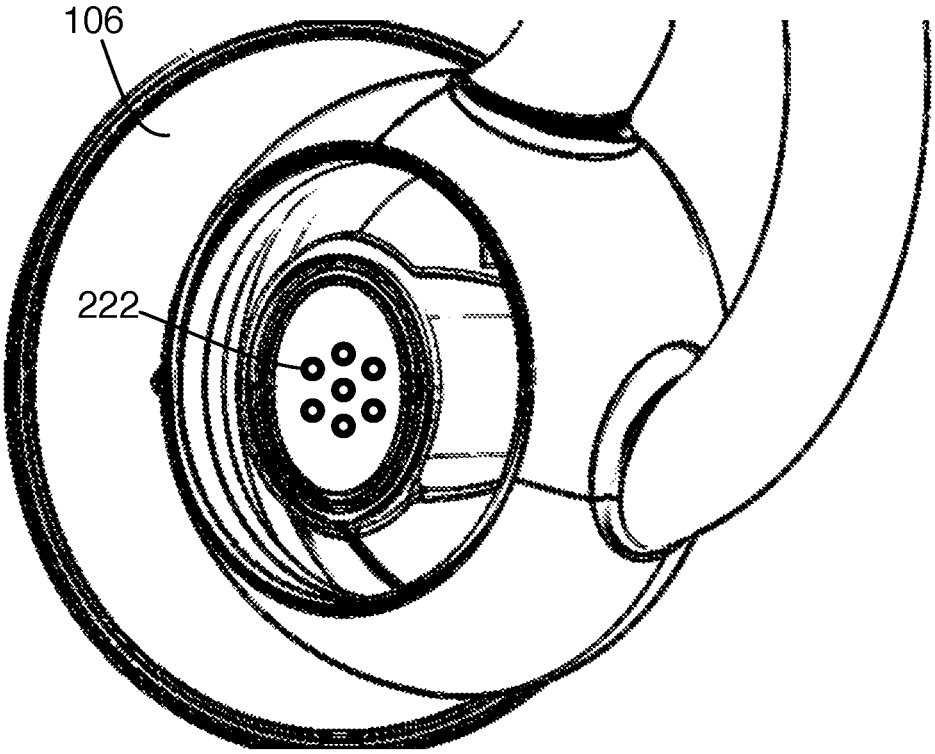
Figure 8:
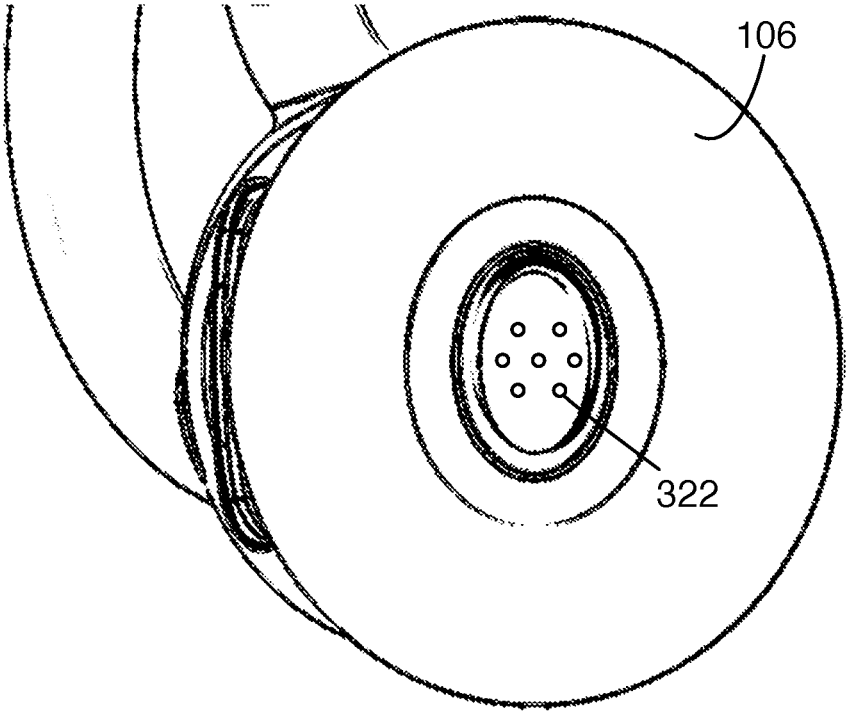
Figure 9:
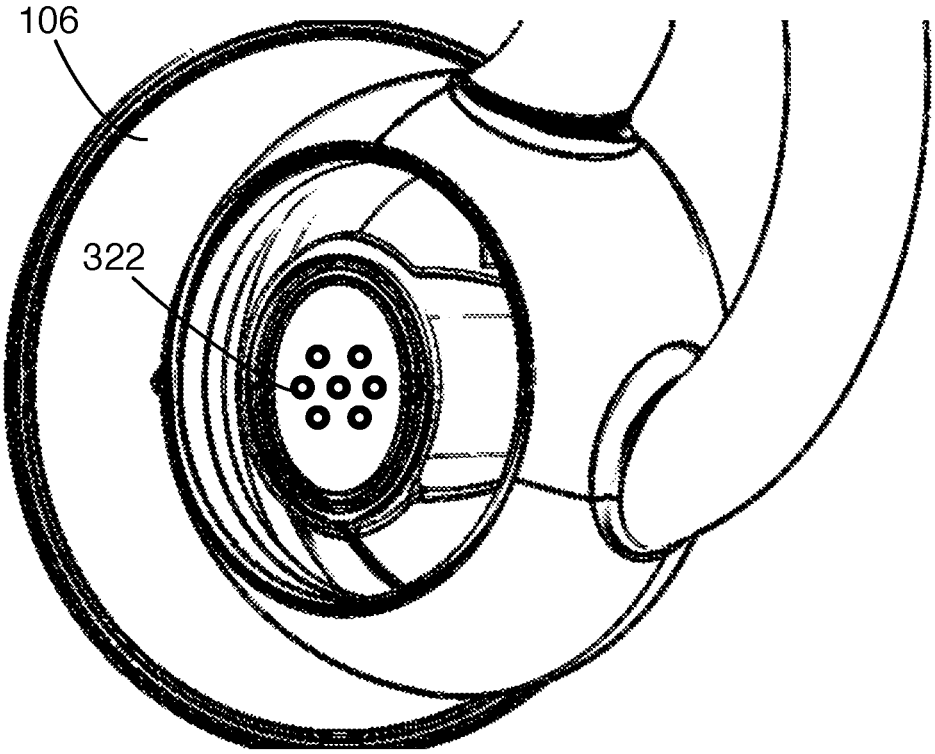
Figure 10A:
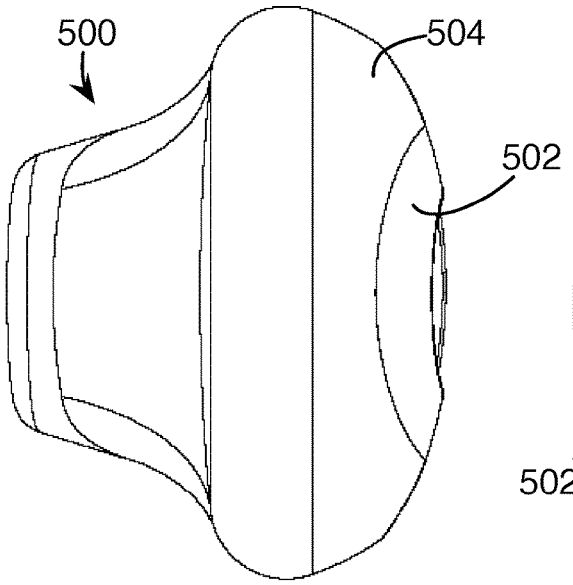
FIGS. 10A, 10B, 10C, and 10D show a back, top, side, and perspective view of an ear tip for an earphone.
Figure 10B:
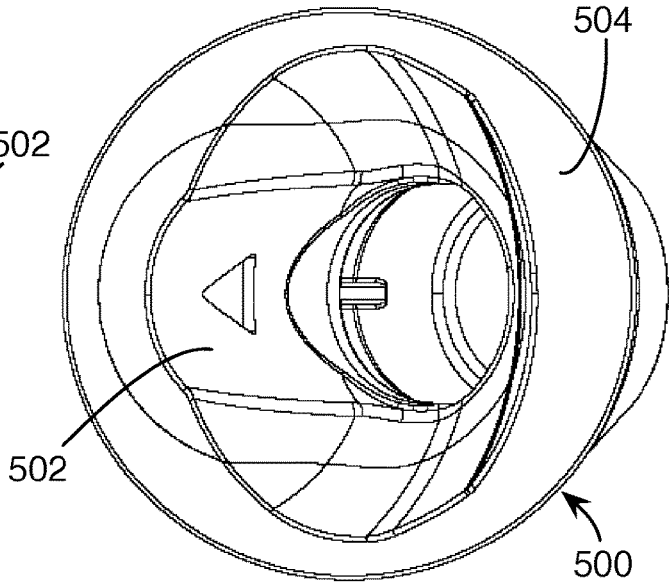
Figure 10C:
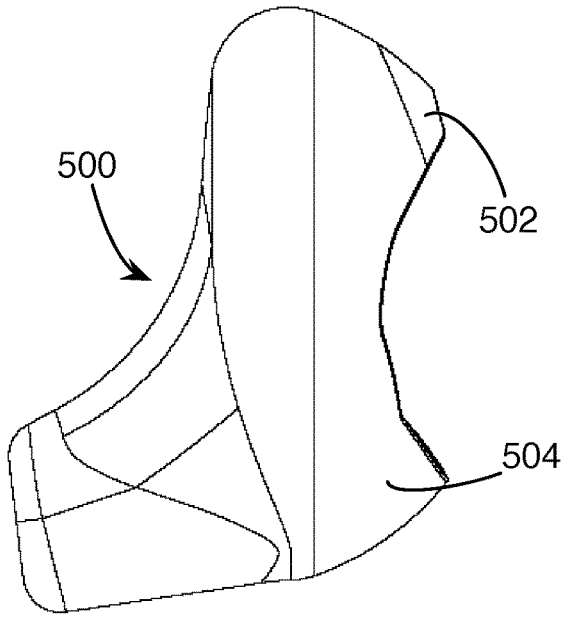
Figure 10D:
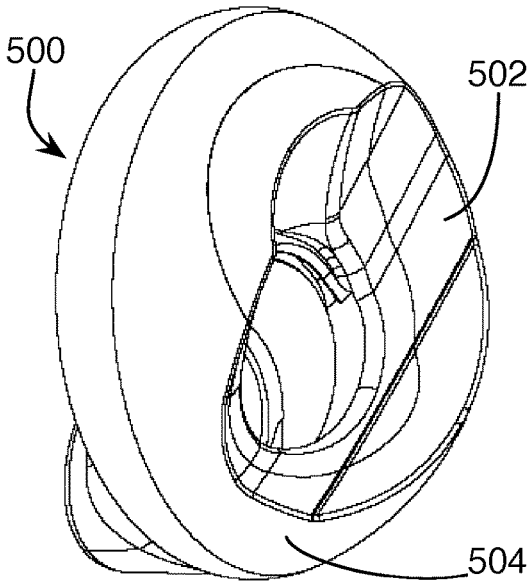

FIGS. 4 and 5, 6 and 7, and 8 and 9 show three alternative arrangements of holes in the guard. FIGS. 4, 6, and 8 show the view of the guard looking into the nozzle extension, and FIGS. 5, 7, and 9 show the view looking into the back of the ear tip 102, with the earphone body 112 removed. In the example of FIGS. 4 and 5, the holes 122 have uniform cross-section, which is also shown in FIG. 2. Seven holes are arranged in a figure-eight pattern, generally covering the elliptical opening of the nozzle, while staying far enough from the edge to allow the holes to be laser-drilled, as discussed below, without interference from the nozzle extension. The size and number of the holes is selected to balance the tradeoff between sound transmission and wax blocking. We have found that the total cross sectional area of all the holes dominates the acoustic performance, while the size and location of individual holes controls the amount of wax ingress. In the examples shown, seven holes having a diameter of 0.31 mm are used, based on the acoustic needs of the earphone used.

In the examples of FIGS. 6 through 9, the holes 222, 322 are tapered, being larger at the inner surface of the guard and smaller at the outer surface. In some examples, the holes had a diameter of 0.31 mm at the narrow end and a 16 degree taper. The holes are arranged in hexagonal pattern around a circle (plus one in the center) in the center of the elliptical nozzle opening. The hexagonal shape is rotated 30° between the example of FIGS. 6 and 7 and that of FIGS. 8 and 9, such that in the example of FIGS. 6 and 7, the long axis of the hexagonal shape is aligned with the long axis of the elliptical shape of the nozzle opening. Conversely, in the examples of FIGS. 8 and 9, the long axis of the hexagonal shape is aligned with the short axis of the elliptical shape of the nozzle opening.

As mentioned earlier, the inner and outer layers of the ear tips are formed of materials having different hardness. The wax guard is formed as part of the inner, harder material in order to better maintain the shape of the holes, and the positioning of the guard relative to the earbud body and the nozzle extension of the ear tip. In particular, the harder material will resist any deformation of the nozzle extension caused by insertion into a particular user's ear canal. In some examples, the outer layer is formed of material having a hardness of 20±4 Shore A, while the inner layer has a hardness in the range of 70 to 85 Shore A. The two layers can be formed using any appropriate manufacturing technique. In one example, they are both formed through injection molding, with the inner core of the harder material being molded first, and then inserted into the mold for the softer outer layer. In other examples, the harder material is molded using compression molding and then placed in the injection mold for the softer outer layer. For the example of FIGS. 2, 4, and 5, with straight-sided holes, the holes may be laser-drilled after the wax guard is molded with an intact plate. For the examples of FIGS. 6 through 9, with tapered holes, the holes may be formed during molding through the use of pins or other appropriate features in the mold.

A number of implementations have been described. Nevertheless, it will be understood that additional modifications may be made without departing from the scope of the inventive concepts described herein, and, accordingly, other embodiments are within the scope of the following claims.

What is claimed is:

1. An ear tip for an earphone, comprising:

an interior mating surface for attaching the ear tip to the earphone, the interior mating surface at least partially surrounding a cavity where the earphone will be located when the ear tip is so attached, an outer surface including features corresponding to human ear anatomy, a nozzle extension providing a passageway from the interior cavity to space outside the ear tip, a wax guard in the nozzle extension, the wax guard blocking the passageway, and a plurality of holes through the wax guard, the holes sized and arranged to allow sound to pass along the passageway, while inhibiting ear wax from passing along the passageway, wherein the holes are tapered in diameter along their extent through the wax guard, having narrower ends on a surface of the wax guard facing out of the passageway and wider ends on a surface of the wax guard facing towards the cavity.

2. The ear tip of claim 1, wherein the wax guard is generally elliptical in shape, with the plurality of holes arranged in a pattern uniformly spread around the wax guard.

3. The ear tip of claim 1, wherein the wax guard is generally elliptical in shape, with the plurality of holes arranged in a pattern confined to a circular shape having a diameter less than the shorter axis of the elliptical shape of the wax guard.

4. The ear tip of claim 1, wherein the holes have a dimeter of around 0.031 mm at their narrow ends.

5. The ear tip of claim 1, wherein:

the ear tip is composed of two different materials having different hardness, a first, harder material providing the interior mating surface, and a second softer material providing the outer surface, wherein the wax guard comprises the first material, in a unitary structure with the material providing the interior mating surface.

6. The ear tip of claim 5, wherein the first material has a hardness between 70 and 85 Shore A.

7. The ear tip of claim 5, wherein the second material has a hardness of 20±4 Shore A.

8. The ear tip of claim 1, wherein the mating surface and the wax guard are positioned, relative to each other, such that when the earphone is attached to the ear tip, a gap will be present between an end of a nozzle of the earphone and the wax guard.

9. An earphone, comprising:

an earphone body, including an aperture through which sound exits, and an exterior surface; and an ear tip for attachment to the earphone, comprising an interior mating surface corresponding to at least a portion of the exterior surface of the earphone body, an outer surface including features corresponding to human ear anatomy, a nozzle extension providing a passageway from the aperture of the earphone body to space outside the earphone, a wax guard in the nozzle extension, the wax guard blocking the passageway, and a plurality of holes through the wax guard, the holes sized and arranged to allow sound to pass along the passageway, while inhibiting ear wax from passing along the passageway, wherein the holes in the wax guard are tapered in diameter along their extent through the wax guard, having narrower ends on a surface of the wax guard facing out of the passageway and wider ends on a surface of the wax guard facing towards the cavity.

10. The earphone of claim 9, wherein the earphone body further comprises a nozzle extending from the earphone body, the aperture located at an end of the nozzle and covered by a screen, and a gap remains between the screen and the wax guard when the ear tip is attached to the earphone.

11. The earphone of claim 9, wherein the wax guard is generally elliptical in shape, with the plurality of holes arranged in a pattern uniformly spread around the wax guard.

12. The earphone of claim 4, wherein the holes have a diameter of around 0.031 mm at their narrow ends.

13. An ear tip for an earphone, comprising:

a first material, having a first hardness, providing an interior mating surface for attaching the ear tip to the earphone, the interior mating surface at least partially surrounding a cavity where the earphone will be located when the ear tip is so attached, a second material, having a second hardness, providing an outer surface including features corresponding to human ear anatomy, a nozzle extension formed of at least the second material, providing a passageway from the interior cavity to space outside the ear tip, a wax guard formed of the first material and located within the nozzle extension, the wax guard blocking the passageway, and a plurality of holes through the wax guard, the holes sized and arranged to allow sound to pass along the passageway, while inhibiting ear wax from passing along the passageway, wherein the holes in the wax guard are tapered in diameter along their extent through the wax guard, having narrower ends on a surface of the wax guard facing out of the passageway and wider ends on a surface of the wax guard facing towards the cavity.

14. The ear tip of claim 13, wherein the wax guard is generally elliptical in shape, with the plurality of holes arranged in a pattern uniformly spread around the wax guard.

15. The ear tip of claim 13, wherein the holes have a diameter of around 0.031 mm at their narrow ends.

16. A method comprising:

forming an inner core of an ear tip in a first molding operation, the inner core defining an interior mating surface for attaching the ear tip to the earphone, the interior mating surface at least partially surrounding a cavity where the earphone will be located when the ear tip is so attached, and a wax guard to prevent wax from entering the earphone;

forming an outer layer over the inner core in a second molding operation, the outer layer defining an outer surface including features corresponding to human ear anatomy, and a nozzle extension providing a passageway from the aperture of the earphone body to space outside the earphone, wherein the wax guard comprises a plate that blocks the passageway, and wherein the method further comprises laser drilling a plurality of holes in the plate, the holes sized and arranged to allow sound to pass along the passageway, while inhibiting ear wax from passing along the passageway, wherein the holes are tapered in diameter along their extent through the wax guard, having narrower ends on a surface of the wax guard facing out of the passageway and wider ends on a surface of the wax guard facing towards the cavity.

17. The method of claim 16, wherein the first molding operation is a compression molding operation and the second molding operation is an injection molding operation.

18. The method of claim 17, wherein the inner core is molded from a first harder material and the outer layer is molded from a second, softer material.

19. The method of claim 16, wherein the first molding operation is a first injection molding operation and the second molding operation is a second injection molding operation.

* * * * *